US007287740B2

(12) United States Patent
Reyes et al.

(10) Patent No.: US 7,287,740 B2
(45) Date of Patent: Oct. 30, 2007

(54) HOISTING APPARATUS

(75) Inventors: Ray A. Reyes, New Windsor, NY (US); David L. Schmoke, Verbank, NY (US); Uldis A. Ziemins, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 182 days.

(21) Appl. No.: 11/163,835

(22) Filed: Nov. 1, 2005

(65) Prior Publication Data

US 2007/0114505 A1 May 24, 2007

(51) Int. Cl.
*B66D 1/26* (2006.01)

(52) U.S. Cl. ..... 254/278; 212/274; 212/84; 212/330

(58) Field of Classification Search ..... 254/278, 254/294, 371; 212/274, 278, 71, 83, 84, 212/330

See application file for complete search history.

(56) References Cited

U.S. PATENT DOCUMENTS 3,887,080 A 6/1975 Wilson
3,899,083 A * 8/1975 Flessner et al. ..... 212/274
4,949,855 A * 8/1990 Foit ..... 212/274
5,048,703 A * 9/1991 Tax et al. ..... 212/276
5,451,032 A * 9/1995 Rhoads ..... 254/399
5,603,420 A * 2/1997 Swanson ..... 212/274
5,673,804 A 10/1997 Weiss et al.
5,765,703 A 6/1998 Shiwaku
5,979,602 A * 11/1999 Grout ..... 182/142
6,102,372 A * 8/2000 Gersemsky et al. ..... 254/278
6,921,061 B2 * 7/2005 Hayashi et al. ..... 254/373

FOREIGN PATENT DOCUMENTS

EP 0246922 A2 11/1987
NL 7113012 A 5/1972

* cited by examiner

*Primary Examiner*—Emmanuel M Marcelo
(74) *Attorney, Agent, or Firm*—Schemeiser, Olsen & Watts; Steven Capella

(57) ABSTRACT

A cable attachment assembly, a hoist and a transportation system using the cable attachment assembly. The cable attachment assembly including: a plate pivotable about a first axis; first and second pivot assemblies pivotable about respective second and third axes, the first, second and third axes parallel to each other; a first cable retainer in the first pivot assembly, the first cable retainer adapted to rotateably retain an end of a first cable in the first cable pivot assembly, the first cable rotatable about a fourth axis; a second cable retainer in the second pivot assembly, the second cable retainer adapted to rotateably retain an end of a second cable in the second pivot assembly, the second cable rotatable about a fifth axis; wherein the fourth and fifth axes parallel to each other and the fourth and fifth axes are perpendicular to the first, second and third axis.

30 Claims, 4 Drawing Sheets

HOISTING APPARATUS

FIELD OF THE INVENTION

The present invention relates to the field of hoisting apparatuses; more specifically, it relates to a multiple hoist cable, multiple attachment point hoisting apparatus.

BACKGROUND OF THE INVENTION

In manufacturing production parts are often transported around the factory from station to station. In some applications, the parts are transported using an overhead lift system. Hoists are used to raise the parts from a station and then the hoist and parts are moved by the overhead rail system to the next station, where the parts are lowered by the hoist system. In one type of hoist, a support platform is suspended by six hoist cables connected to three points on a platform adapted to grasp the parts or a container holding the parts. The hoist cables are reeled up or down simultaneously the same distance and at the same rate. Such hoist systems are not subject to side-to-side sway and twisting and are used where delicate parts and high location precision is required. However, in such systems, the hoist cables easily develop kinks or could unravel from internal tension fatigue failure which can cause the platform to tilt and the reels to bind, adversely affecting the precision of the delivery or damaging the parts. Replacement of hoist cables in such hoist systems is also expensive and time consuming.

Therefore, there is a need for improved hoist cable hoist systems with improved hoist cable life.

SUMMARY OF THE INVENTION

A first aspect of the present invention is a hoist cable attachment assembly for attaching a pair of hoist cables to a payload gripping mechanism, comprising: a plate pivotable about a first axis; a first hoist cable pivot assembly pivotable about a second axis and a second hoist cable pivot assembly pivotable about a third axis, the first and second hoist cable pivot assemblies disposed on opposite sides of the plate, the first, second and third axes parallel to each other; a first hoist cable retaining means in the first pivot assembly, the first hoist cable retaining means adapted to rotateably retain a first end of a first hoist cable of the pair of hoist cables in the first hoist cable pivot assembly, the first hoist cable rotatable about a fourth axis; a second hoist cable retaining means in the second pivot assembly, the second hoist cable retaining means adapted to rotateably retain a first end of a second hoist cable of the pair of hoist cables in the second hoist cable pivot assembly, the second hoist cable rotatable about a fifth axis; wherein the fourth and fifth axes are parallel to each other and the fourth and fifth axes are perpendicular to the first, second and third axis; and a bracket for attaching the hoist cable attachment assembly to the payload gripping mechanism.

A second aspect of the present invention is a hoist system for lifting and lowering a payload, comprising: a lifting mechanism comprising three pairs of hoist cable drums disposed on a first frame, the pairs of hoist cable drums disposed at angles of about 120° to each other, each hoist cable drum of each pair of hoist cable drums longitudinally aligned to a same axis; a payload gripping mechanism having three hoist cable attachment assemblies attached to a second frame, the hoist cable attachment assemblies disposed at angles of about 120° to each other, each hoist cable attachment assembly having a first set of three parallel axes and a second set of two parallel axes, the first set of axes perpendicular to the second set of axes, each hoist cable attachment assembly having a pair of hoist cable pivot assemblies; three pairs of hoist cables, a first end of a first hoist cable of each pair of hoist cables attached to a first hoist cable drum and a first end of a second hoist cable of each pair of hoist cables attached to a second hoist cable drum of one of the three pairs of co-joined hoist cable drums, a second end of the first hoist cable of each pair of hoist cables attached to a first hoist cable pivot assembly and a second end of the second hoist cable of each pair of hoist cables attached to a second hoist cable pivot assembly of one of the three pairs of pivot assemblies; and wherein each hoist cable attachment assembly is pivotable about a center axis of a corresponding the first set of three axes, each hoist cable pivot assembly of each pair of hoist cable pivot assemblies is pivotable about a different outer axis of the corresponding the first set of three axes, and each hoist cable of each pair of hoist cables is rotatable about a different axis of a corresponding the second set of two axes.

A third aspect of the present invention is a transportation system for lifting and lowering a payload, comprising: an overhead rail transportation system; a lifting mechanism coupled to the overhead rail transportation system, the lifting mechanism comprising three pairs of hoist cable drums disposed on a first frame, the pairs of hoist cable drums disposed at angles of about 120° to each other, each hoist cable drum of each pair of hoist cable drums longitudinally aligned to a same axis; a payload gripping mechanism having three hoist cable attachment assemblies attached to a second frame, the hoist cable attachment assemblies disposed at angles of about 120° to each other, each hoist cable attachment assembly having a first set of three parallel axes and a second set of two parallel axes, the first set of axes perpendicular to the second set of axes, each hoist cable attachment assembly having a pair of hoist cable pivot assemblies; three pairs of hoist cables, a first end of a first hoist cable of each pair of hoist cables attached to a first hoist cable drum and a first end of a second hoist cable of each pair of hoist cables attached to a second hoist cable drum of one of the three pairs of co-joined hoist cable drums, a second end of the first hoist cable of each pair of hoist cables attached to a first hoist cable pivot assembly and a second end of the second hoist cable of each pair of hoist cables attached to a second hoist cable pivot assembly of one of the three pairs of pivot assemblies; and wherein each hoist cable attachment assembly is pivotable about a center axis of a corresponding the first set of three axes, each hoist cable pivot assembly of each pair of hoist cable pivot assemblies is pivotable about a different outer axis of the corresponding the first set of three axes, and each hoist cable of each pair of hoist cables is rotatable about a different axis of a corresponding the second set of two axes.

BRIEF DESCRIPTION OF DRAWINGS

The features of the invention are set forth in the appended claims. The invention itself, however, will be best understood by reference to the following detailed description of an illustrative embodiment when read in conjunction with the accompanying drawings, wherein:

DETAILED DESCRIPTION OF THE INVENTION

Figure 1A:
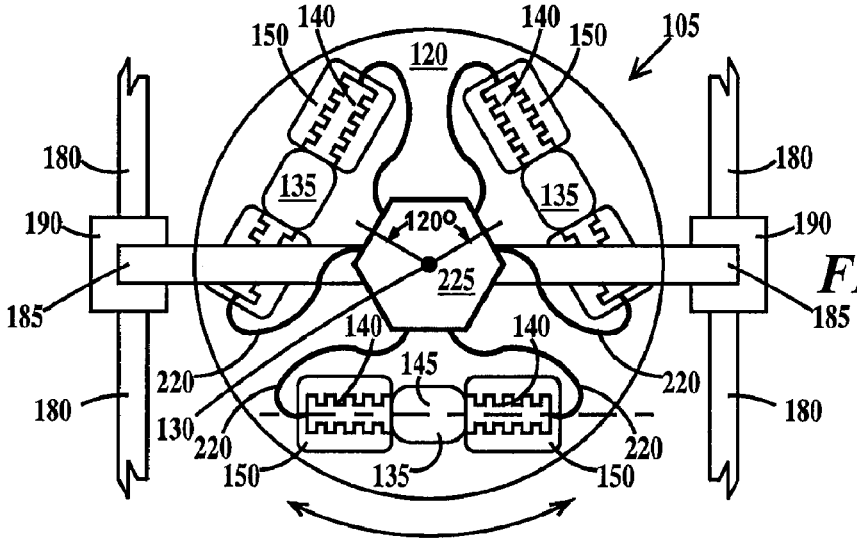
FIG. 1A is top view and FIG. 1B is a side view of a hoist system according to the embodiments of the present invention.
Figure 1B:
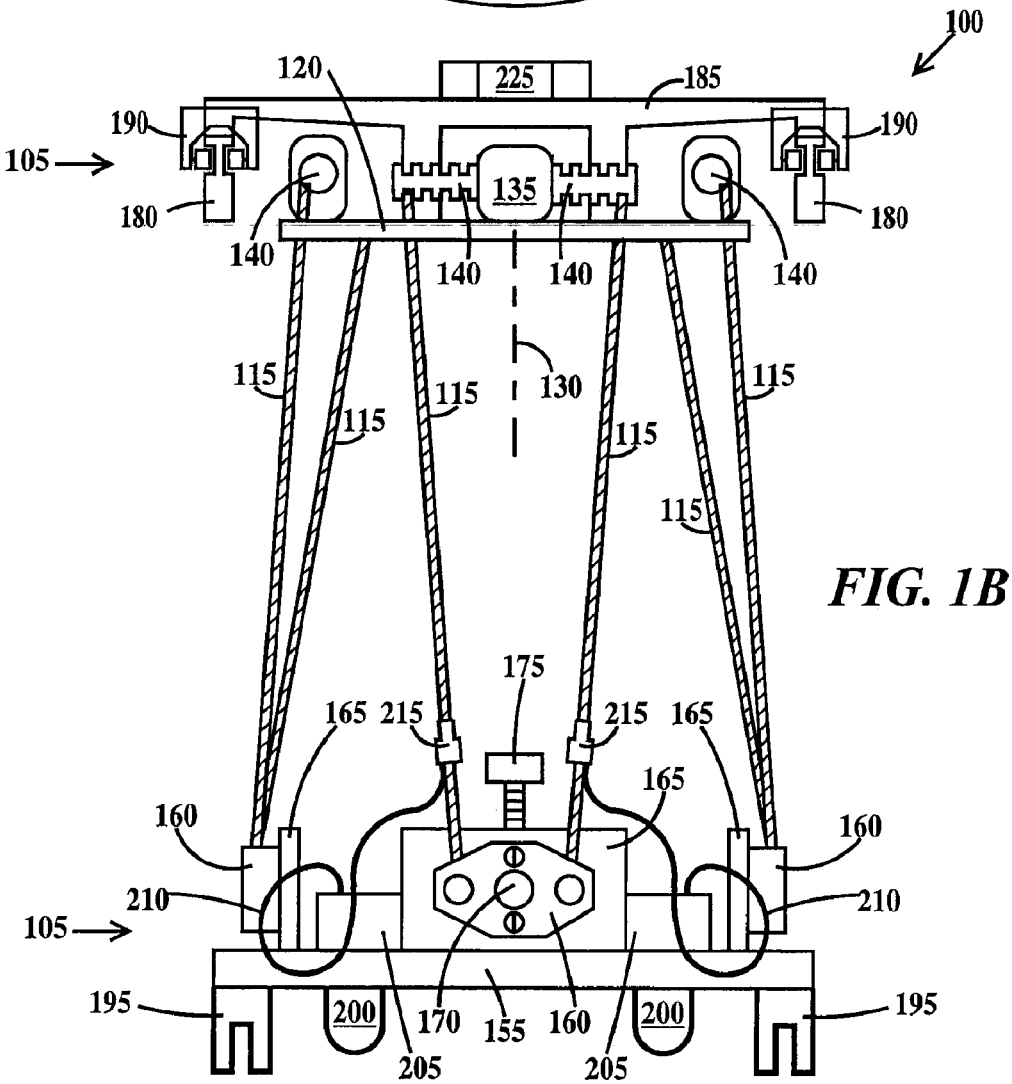

FIG. 1A is top view and FIG. 1B is a side view of a hoist system 100 according to the embodiments of the present invention. In FIGS. 1A and 1B, hoist system 100 includes a lifting mechanism 105 and a payload gripping mechanism 110 connected by hoist cables 115.

Lifting mechanism 105 of hoist system 100 includes a frame 120 on which are mounted three winches 125 arranged at angles of about 120° to each other around a central axis 130. Frame 120 is rotatable about central axis 130. Each winch 125 includes a motor 135 for turning a pair of hoist cable drums 140 disposed on opposite side of the motor. Each pair of hoist cable drums 140 has a common longitudinal axis 145. There is a slot 150 in frame 120 under each hoist cable drum 150 through which corresponding hoist cables 115 may pass. Hoist cable drums 140 are grooved to receive hoist cables 115 as the hoist cables are wound onto the hoist cable drums.

Payload gripping mechanism 110 of hoist system 100 includes a frame 155 to which are attached three hoist cable attachment assembles 160. Hoist cable attachment assemblies 160 are arranged at angles of about 120° to each other similar to the arrangement of winches 125. Each hoist cable attachment assembly 160 is adapted to connect a pair of hoist cables 115 from the same winch 125. Each hoist cable attachment assembly is attached to frame 155 by a bracket 165. Each hoist cable attachment assembly 160 is attached to each bracket by a main pivot pin 170 and is free to pivot about the main pivot pin, which has a longitudinal axis parallel to a plane defined by frame 155. Each hoist cable attachment assembly 160 is provided with an adjustment screw 175 for adjusting the rotational resistance about main pivot pin 170.

Hoist cables 115 are under tension and provide six horizontal force components in three non-parallel planes. In order to raise and lower frame 155 relative to frame 120, all six hoist cable drums 140 are rotated simultaneously by motors 135, thereby causing each hoist cable 115 to wind or unwind from its corresponding hoist cable drum. Alternatively, a single motor may be adapted to drive all six drums 140.

Hoist system 100 is illustrated in conjunction with a rail transport system. For example, in the transport system shown, rails 180 are arranged to run to various locations or tools in a factory. Frame 120 is attached to rails 180 by a bracket 185 through dollies 190. Such rail systems are well known, particularly in the semiconductor industry.

Frame 155 is fitted with grippers 195 for gripping a payload. In one example, grippers 195 are configured to grip a carrier containing semiconductor wafers, and location sensors 200 for locating the payload and positioning grippers 195 over the payload. Location sensors may be mechanical, electro-mechanical, or optical-mechanical.

In one example, hoist cables 115 comprise wire rope with a plastic coating. As such, hoist cables 115 are electrically conductive and may be used to transport signals between lifting mechanism 105 and payload gripping mechanism 110 of hoist assembly 100. To such end, a transceiver 205 is mounted to frame 155 and electrically connected by electric wires 210 to hoist cables 115 by clamps 215 (after stripping away a portion of the plastic coating). Hoist cable drums 140 may be fitted with electrically conductive and isolated rings and brushes adapted to electrically couple hoist cables 115 to corresponding wires 220 and thence to a transceiver 225. Transceiver 225 is in communication with a controller in the factory for controlling positioning of hoist system 100 relative to stations and tools in the factory. The signals applied to hoist cables 115 may be analog signals, digital signals or power.

Figure 2:
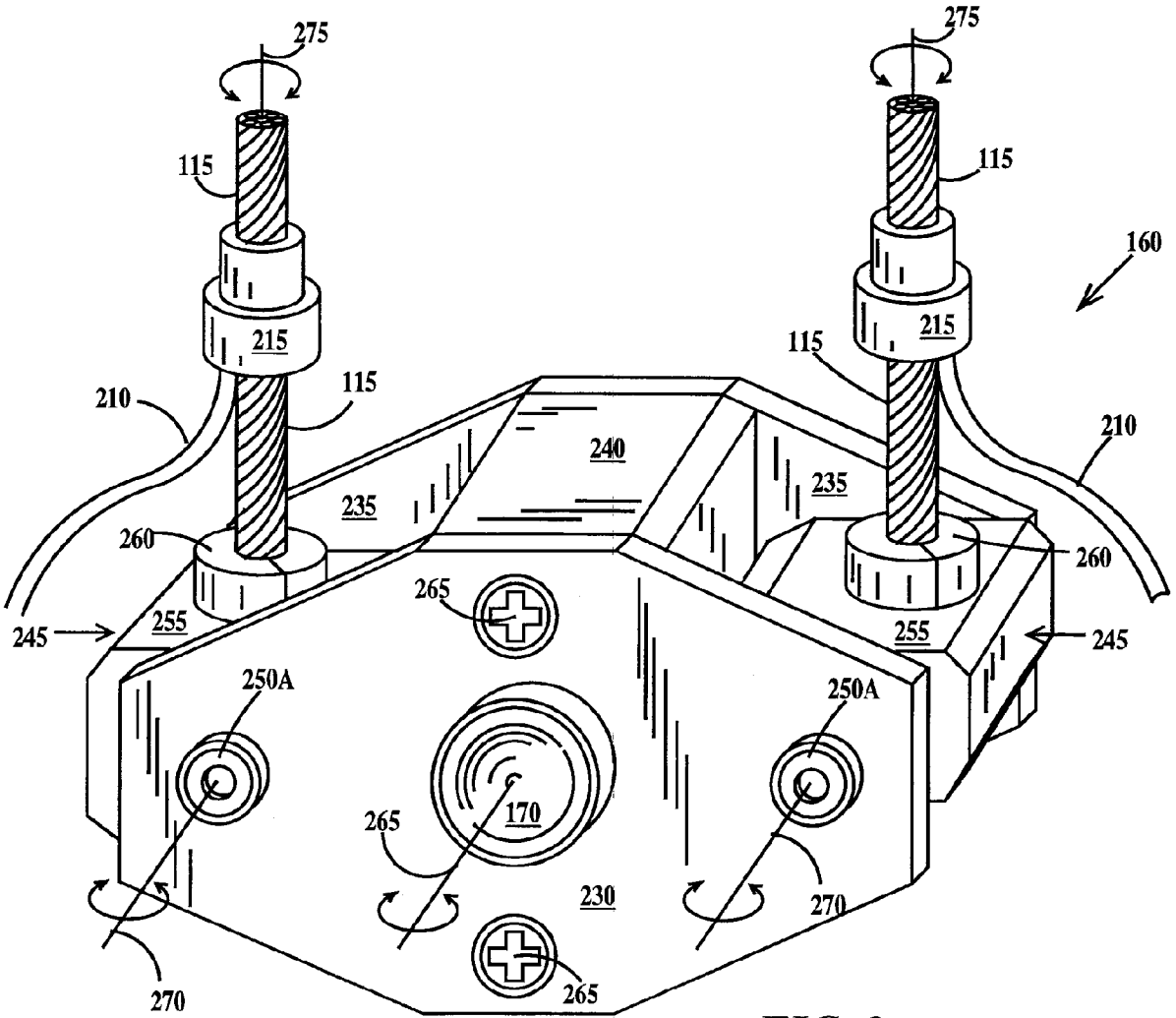
FIG. 2 is an isometric view of a hoist cable attachment assembly according to the embodiments of the present invention.

FIG. 2 is an isometric view of hoist cable attachment assembly 160 according to the embodiments of the present invention. In FIG. 2, hoist cable attachment assembly 160 includes a front plate 230 and a back plate 235 held apart by a spacer 240. Main pivot pin 170 passes through holes in front plate 230, back plate 235 and spacer 240 and is fixed to bracket 165 (see FIG. 1B). A pair of hoist cable pivot assemblies 245 are held between front and back plates 230 and 245 by hoist cable pivot pins 250A and 250B (not shown, see FIG. 3A) on opposite sides of main pivot pin 170. Each hoist cable pivot assembly 245 includes a hoist cable pivot body 255 and a hoist cable retainer 260. For each hoist cable pivot assembly, respective hoist cable pivot pins 250A extend through a circular hole in front plate 230 into hoist cable pivot body 255 and are fixed in the hoist cable pivot body. Similarly, respective hoist cable pivot pins 250B (not shown, see FIG. 3A) extend through back plate 230 into hoist cable pivot body 255 and are fixed in the hoist cable pivot body. Hoist cable attachment assembly 160 is held together by screws 265.

Main pivot pin 170 extends along a longitudinal axis 265 and the entire hoist cable attachment assembly 160 is free to pivot about axis 265. Each pair of pivot pins 250A and 250B is aligned along a common longitudinal axis 270 running through respective hoist cable pivot pins 250A and 250B (not shown, see FIG. 3A) and each hoist cable pivot assembly 245 is free to pivot about its respective axis 270. Axis 265 and both axes 270 are parallel to each other. In one example, axis 265 and axes 270 lie in the same plane.

Each hoist cable 115 is free to rotate along a respective axes 275 passing through hoist cable retainer 260. Each axis 275 is perpendicular to axes 265 and both axes 270. Both axes 275 are parallel to each other.

Figure 3A:
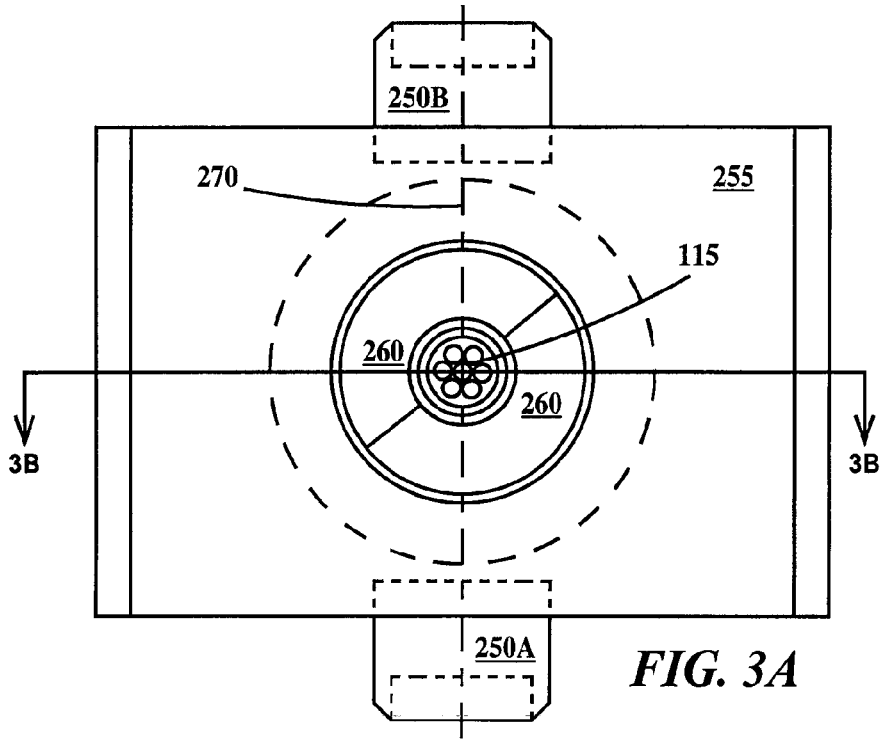
FIG. 3A is a top view of a hoist cable pivot assembly according to the embodiments of the present invention.
Figure 3B:
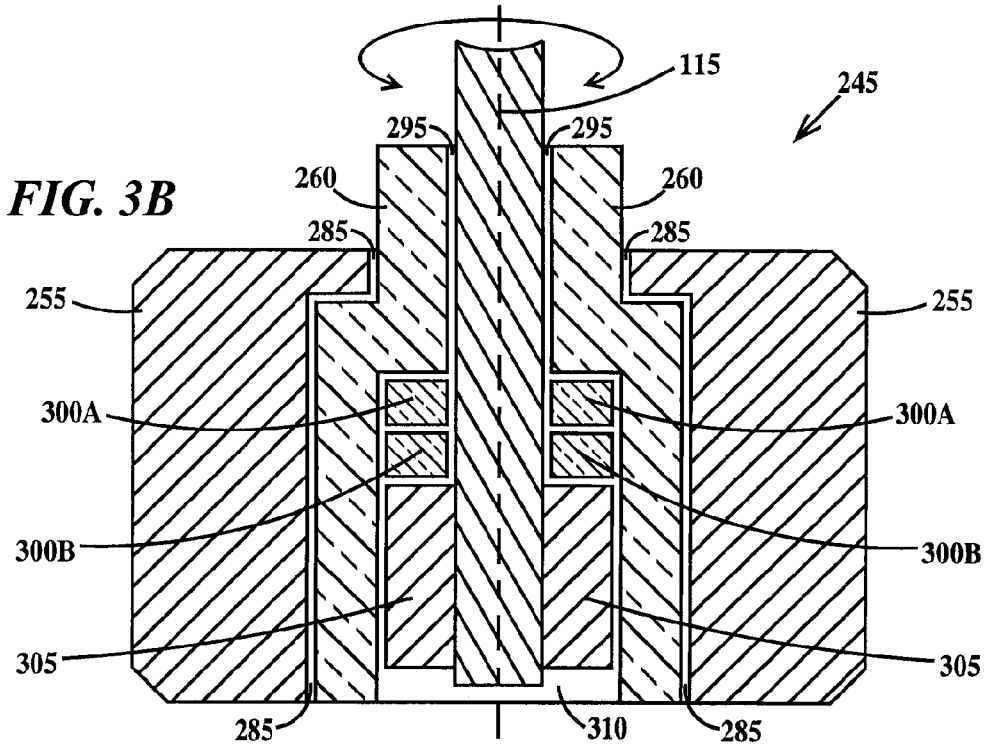
FIG. 3B is a cross-section through line 3B-3B of FIG. 3A.

FIG. 3A is a top view of hoist cable pivot assembly 245 according to the embodiments of the present invention and FIG. 3B is a cross-section through line 3B-3B of FIG. 3A. In FIGS. 3A and 3B, hoist cable retainer 260 fits into a chamber 280 in hoist cable pivot body 255. An upper portion of hoist cable retainer 260 extend through a cylindrical hole 285 in hoist cable pivot body 255. Hoist cable retainer 260 also includes a chamber 290. Hoist cable 115 passes through a cylindrical hole 295 in hoist cable retainer 260, through thrust washers 300A and 300B and into a cylindrical hole in a hoist cable stop 305. Thrust washers 300A and 300B and hoist cable stop 305 are contained within chamber 310 of hoist cable retainer 260. Hoist cable stop 305 is swaged onto hoist cable 115. Hoist cable 115 and hoist cable stop 305 are free to rotate about axis 275. In one example, hoist cable retainer 260 is free to rotate along axis 275. In one example, hoist cable retainer 260 is press fitted, pinned, or otherwise restrained from rotating along axis 275.

Hoist cable pivot body 255 may advantageously be fabricated from aluminum or stainless steel. Hoist cable retainer 260 may advantageously be fabricated from nylon, polyfluoroethylene, other plastics, polymers or resins. Thrust washers 300A and 300B may advantageously be fabricated from stainless steel, oil filled bronze, nylon, polyfluoroethylene, other plastics, polymers or resins. While two thrust washers are illustrated in FIG. 3B, more than two, one or none may be employed. Alternatively, various other types of thrust bearings including ball and roller pin bearing may be used in place of or in conjunction with thrust washers 300A and 330B.

The design of hoist cable pivot body 255 may be considered exemplary and other designs may be used, as for example, designs incorporating slots to make replacement of hoist cable 115 easier.

Figure 4:
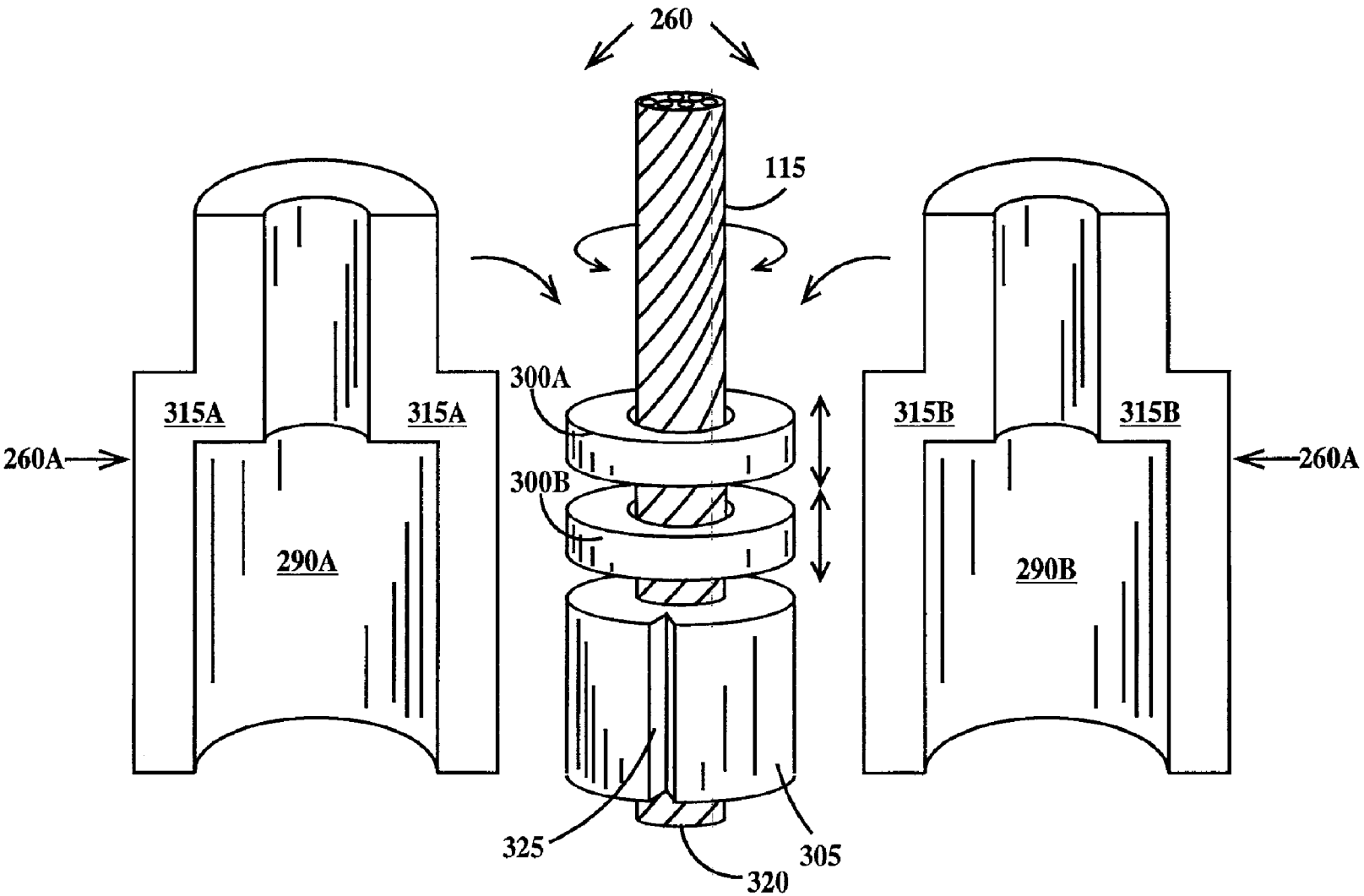
FIG. 4 is an assembly drawing of a hoist cable in a hoist cable retainer according to the embodiments of the present invention.

FIG. 4 is an assembly drawing of hoist cable 115 in hoist cable retainer 260 and according to the embodiments of the present invention. As is apparent from FIG. 4, hoist cable retainer 260 comprises two identical half 260A and 260B having respective mating surfaces 315A and 315B. In one example, thrust washers 300A and 300B are slipped over an end 320 of hoist cable 115. Next, hoist cable stop 305 is slipped over end 320 of hoist cable 115 and swaged, leaving an indent 325 in the hoist cable stop and fixing hoist cable 115 in hoist cable stop 305. Next mating surfaces 315A and 315B of respective halves 260A and 260B of the hoist cable retainer are brought together enclosing end 320 of hoist cable 115, hoist cable stop 305 and thrust washers 300A and 330B within a chamber formed by the two semi-cylindrical notches 290A and 290B.

The assembled hoist cable retainer may then be placed into a hoist cable pivot body, and two hoist cable pivot body assemblies placed in a hoist cable attachment assembly.

In tests conducted by the inventors, a set of hoisting systems similar to the hoisting system of the embodiments of the present invention, except that the hoist cable was constrained from any rotation within the hoist cable pivot body experienced hoist cable failures (a kink or an unraveled wire) at the rate of about 1 hoist cable per system per year or about every 20,000 lift cycles, a cycle being one up and one down movement. A hoisting system according to the embodiments of the present invention wherein the hoist cable was free to rotate within the hoist cable pivot body experienced no hoist cable failures after four years of testing or after about 150,000 lift cycles.

Thus the present invention provides an improved hoist cable hoist systems with improved hoist cable life.

The description of the embodiments of the present invention is given above for the understanding of the present invention. It will be understood that the invention is not limited to the particular embodiments described herein, but is capable of various modifications, rearrangements and substitutions as will now become apparent to those skilled in the art without departing from the scope of the invention. Therefore, it is intended that the following claims cover all such modifications and changes as fall within the true spirit and scope of the invention.

What is claimed is:

1. A hoist cable attachment assembly for attaching a pair of hoist cables to a payload gripping mechanism, comprising:

a plate pivotable about a first axis;

a first hoist cable pivot assembly pivotable about a second axis and a second hoist cable pivot assembly pivotable about a third axis, said first and second hoist cable pivot assemblies disposed on opposite sides of said plate, said first, second and third axes parallel to each other;

a first hoist cable retaining means in said first pivot assembly, said first hoist cable retaining means adapted to rotateably retain a first end of a first hoist cable of said pair of hoist cables in said first hoist cable pivot assembly, said first hoist cable rotatable about a fourth axis;

a second hoist cable retaining means in said second pivot assembly, said second hoist cable retaining means adapted to rotateably retain a first end of a second hoist cable of said pair of hoist cables in said second hoist cable pivot assembly, said second hoist cable rotatable about a fifth axis;

wherein said fourth and fifth axes are parallel to each other and said fourth and fifth axes are perpendicular to said first, second and third axis; and 1a bracket for attaching said hoist cable attachment assembly to said payload gripping mechanism.

2. The hoist cable attachment assembly of claim 1, wherein said first and second hoist cable retaining means each comprise:

a hoist cable pivot body having a first chamber;

a hoist cable retainer having a second chamber, said hoist cable retainer disposed in said first chamber; and a hoist cable stop fixedly attached to an end of one hoist cable of said pair of hoist cables, said hoist cable stop rotateably disposed in said second chamber.

3. The hoist cable attachment assembly of claim 2, further including one or more thrust washers disposed, said one hoist cable of said pair of hoist cables passing through said one or more thrust washers, said one or more thrust washers contained within said second chamber.

4. The hoist cable attachment assembly of claim 3, wherein each of said one or more thrust washers are independently fabricated from stainless steel, oil filled bronze, nylon, polyfluoroethylene, other plastics, polymers or resins.

5. The hoist cable attachment assembly of claim 2, further including a ball, pin or roller bearing, said one hoist cable of said pair of hoist cables passing through said ball, pin or roller bearing, said ball, pin or roller bearing contained within said second chamber.

6. The hoist cable attachment assembly of claim 2, wherein said hoist cable retainer is fabricated from nylon, polyfluoroethylene, other plastics, polymers or resins.

7. The hoist cable attachment assembly of claim 2, wherein said hoist cable retainer is rotatable about either said fourth or fifth axis.

8. The hoist cable attachment assembly of claim 2, wherein said hoist cable retainer is fixed within said first chamber.

9. The hoist cable attachment assembly of claim 2, wherein said hoist cable retainer comprises two identical halves symmetrical about said fourth axis or said fifth axis.

10. The hoist cable attachment assembly of claim 2, wherein said hoist cable pivot body is rotateably retained in said hoist cable attachment assembly by pins.

11. The hoist cable attachment assembly of claim 1, wherein said first, second and third axes are disposed in a same plane, said plane pivotable about said first axis.

12. A hoist system for lifting and lowering a payload, comprising:

a lifting mechanism comprising three pairs of hoist cable drums disposed on a first frame, said pairs of hoist cable drums disposed at angles of about 120° to each other, each hoist cable drum of each pair of hoist cable drums longitudinally aligned to a same axis;

a payload gripping mechanism having three hoist cable attachment assemblies attached to a second frame, said hoist cable attachment assemblies disposed at angles of about 120° to each other, each hoist cable attachment assembly having a first set of three parallel axes and a second set of two parallel axes, said first set of axes perpendicular to said second set of axes, each hoist cable attachment assembly having a pair of hoist cable pivot assemblies;

three pairs of hoist cables, a first end of a first hoist cable of each pair of hoist cables attached to a first hoist cable drum and a first end of a second hoist cable of each pair of hoist cables attached to a second hoist cable drum of one of said three pairs of co-joined hoist cable drums, a second end of said first hoist cable of each pair of hoist cables attached to a first hoist cable pivot assembly and a second end of said second hoist cable of each pair of hoist cables attached to a second hoist cable pivot assembly of one of said three pairs of pivot assemblies; and wherein each hoist cable attachment assembly is pivotable about a center axis of a corresponding said first set of three axes, each hoist cable pivot assembly of each pair of hoist cable pivot assemblies is pivotable about a different outer axis of said corresponding said first set of three axes, and each hoist cable of each pair of hoist cables is rotatable about a different axis of a corresponding said second set of two axes.

13. The hoist system of claim 12, wherein said payload gripping mechanism is configured to grip a carrier containing semiconductor wafers.

14. The hoist system of claim 12, wherein said payload gripping mechanism includes location sensors.

15. The hoist system of claim 12, wherein said lifting mechanism and said payload gripping mechanism each include a transceiver for sending and receiving analog, digital or power signals through one or more hoist cables of said three pairs of hoist cables.

16. The hoist system of claim 12, wherein each said hoist cable pivot assembly comprises:

a hoist cable pivot body having a first chamber;

a hoist cable retainer having a second chamber, said hoist cable retainer disposed in said first chamber; and a hoist cable stop fixedly attached to an end of one hoist cable of said three pairs of hoist cables, said hoist cable stop rotateably disposed in said second chamber.

17. The hoist system of claim 16, further including one or more thrust washers, said one hoist cable of said pair of hoist cables passing through said one or more thrust washers, said one or more thrust washers contained within said second chamber.

18. The hoist system of claim 16, further including a ball, pin or roller bearing, said one hoist cable of said pair of hoist cables passing through said ball, pin or roller bearing, said ball, pin or roller bearing contained within said second chamber.

19. The hoist system of claim 16, said wherein said hoist cable retainer is rotatable about one axis of said second set of two axes.

20. The hoist system of claim 16, wherein said hoist cable retainer is fixed within said first chamber.

21. A transportation system for lifting and lowering a payload, comprising:

an overhead rail transportation system;

a lifting mechanism coupled to said overhead rail transportation system, said lifting mechanism comprising three pairs of hoist cable drums disposed on a first frame, said pairs of hoist cable drums disposed at angles of about 120° to each other, each hoist cable drum of each pair of hoist cable drums longitudinally aligned to a same axis;

a payload gripping mechanism having three hoist cable attachment assemblies attached to a second frame, said hoist cable attachment assemblies disposed at angles of about 120° to each other, each hoist cable attachment assembly having a first set of three parallel axes and a second set of two parallel axes, said first set of axes perpendicular to said second set of axes, each hoist cable attachment assembly having a pair of hoist cable pivot assemblies;

three pairs of hoist cables, a first end of a first hoist cable of each pair of hoist cables attached to a first hoist cable drum and a first end of a second hoist cable of each pair of hoist cables attached to a second hoist cable drum of one of said three pairs of co-joined hoist cable drums, a second end of said first hoist cable of each pair of hoist cables attached to a first hoist cable pivot assembly and a second end of said second hoist cable of each pair of hoist cables attached to a second hoist cable pivot assembly of one of said three pairs of pivot assemblies; and wherein each hoist cable attachment assembly is pivotable about a center axis of a corresponding said first set of three axes, each hoist cable pivot assembly of each pair of hoist cable pivot assemblies is pivotable about a different outer axis of said corresponding said first set of three axes, and each hoist cable of each pair of hoist cables is rotatable about a different axis of a corresponding said second set of two axes.

22. The transportation system of claim 21, wherein said payload gripping mechanism is configured to grip a carrier containing semiconductor wafers.

23. The transportation system of claim 21, wherein said payload gripping mechanism includes location sensors.

24. The transportation system of claim 21, wherein said lifting mechanism and said payload gripping mechanism each include a transceiver for sending and receiving analog, digital or power signals through one or more hoist cables of said three pairs of hoist cables.

25. The transportation system of claim 21, wherein each said hoist cable pivot assembly comprises:

a hoist cable pivot body having a first chamber;

a hoist cable retainer having a second chamber, said hoist cable retainer disposed in said first chamber; and a hoist cable stop fixedly attached to an end of one hoist cable of said three pairs of hoist cables, said hoist cable stop rotateably disposed in said second chamber.

26. The transportation system of claim 25, further including one or more thrust washers, said one hoist cable of said pair of hoist cables passing through said one or more thrust washers, said one or more thrust washers contained within said second chamber.

27. The transportation system of claim 25, further including a ball, pin or roller bearing, said one hoist cable of said pair of hoist cables passing through said ball, pin or roller bearing, said ball, pin or roller bearing contained within said second chamber.

28. The transportation system of claim 25, wherein said hoist cable retainer is rotatable about one axis of said second set of two axes.

29. The transportation system of claim 25, wherein said hoist cable retainer is fixed within said first chamber.

30. The transportation system of claim 21, wherein said transceiver are in communication with a controller in a factory for controlling positioning of said lifting mechanism and said payload gripping mechanism.

* * * * *